US005217545A

United States Patent [19]

Smith et al.

[11] Patent Number: 5,217,545

[45] Date of Patent: * Jun. 8, 1993

[54] HEATER SHEATH ALLOY

[75] Inventors: Gaylord D. Smith; Walter H. Wendler; David B. O'Donnell, all of Huntington, W. Va.

[73] Assignee: Inco Alloys International, Inc., Huntington, W. Va.

[ * ] Notice: The portion of the term of this patent subsequent to Nov. 3, 2009 has been disclaimed.

[21] Appl. No.: 889,556

[22] Filed: May 27, 1992

Related U.S. Application Data

[63] Continuation-in-part of Ser. No. 822,084, Jan. 17, 1992, Pat. No. 5,160,382.

[51] Int. Cl.[5] ..... C22C 38/50

[52] U.S. Cl. ..... 148/327; 420/41

[58] Field of Search ..... 148/327; 420/54, 53

[56] References Cited

U.S. PATENT DOCUMENTS

| | | | |
|---|---|---|---|
| 3,362,813 | 1/1968 | Ziolkowski | 420/54 |
| 3,729,308 | 4/1973 | Eiselstein et al. | 420/53 |
| 5,087,414 | 2/1992 | Maniar | 420/43 |

OTHER PUBLICATIONS

Metals Handbook Ninth Edition, Volume 3, Properties and Selection: Stainless Steels, Tool Materials and Special-Purpose Metals, ASM, pp. 5, 9, Dec. 1980.

Sievart et al., "Ferrite Number Predicion to 100 FN in Stainless Steel Weld Metal", *American Welding Society Publication, Welding Research Supplement*, pp. 289-s to 298-s, Dec. 1988.

*Primary Examiner*—Deborah Yee

*Attorney, Agent, or Firm*—Bruce S. Londo; Edward A. Steen

[57] ABSTRACT

A material for electric heater element sheathing, which has good weldability, is oxidation- and corrosion-resistant, and forms an eye-pleasing dark gray or black surface oxide, consists essentially of, by weight, from about 8.75-15.5% nickel, about 19.5-21.0% chromium, about 0.30-0.50 manganese, about 0.50-2.0% silicon, about 0.25-0.60% aluminum, about 0.25-1.0% titanium, up to about 0.05% carbon, up to about 0.005% sulfur, up to about 0.75% copper, up to about 1.0% cobalt, up to about 1.0% molybdenum, up to about 0.02% phosphorus, about 0.001-0.015% calcium plus magnesium and remainder essentially iron, wherein the Ferrite Number is between 1 and 15.

12 Claims, 1 Drawing Sheet

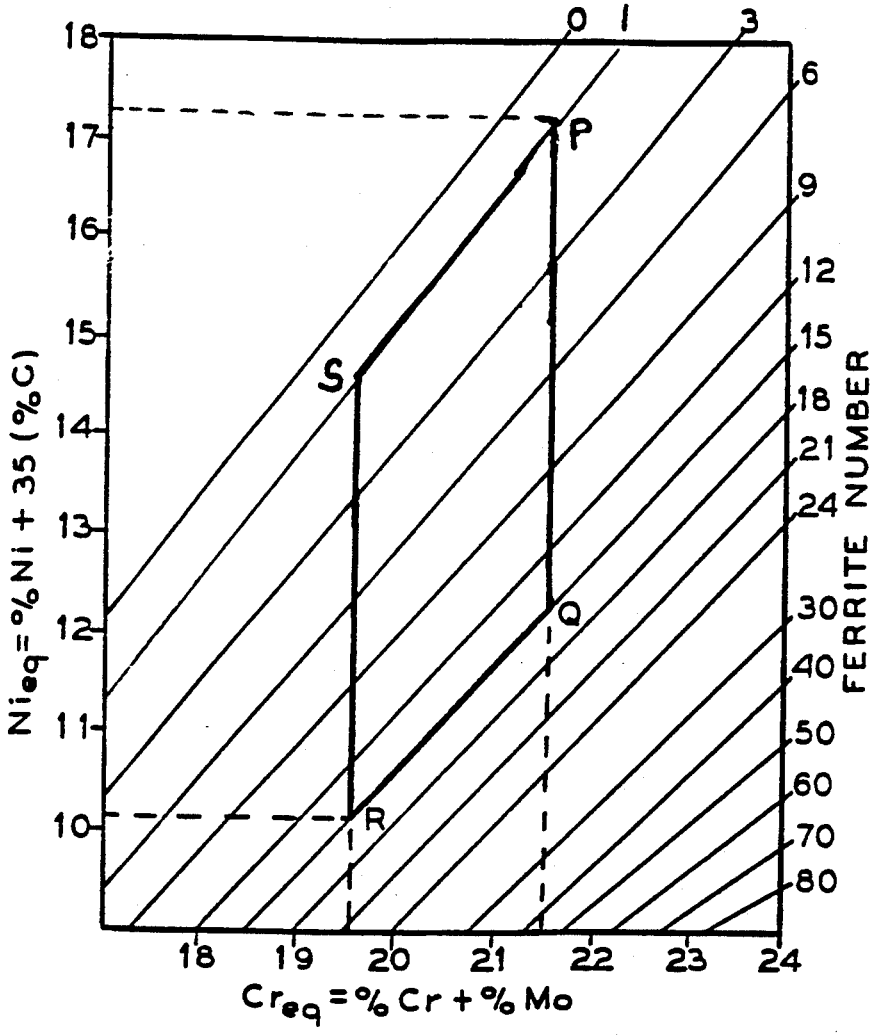
18
17
16
15
14
13
12
11
10
$Ni_{eq}$ = % Ni + 35 (% C)
18
19
20
21
22
23
24
$Cr_{eq}$ = % Cr + % Mo
0
1
3
6
9
12
15
18
21
24
30
40
50
60
70
80
FERRITE NUMBER
P
Q
R
S

HEATER SHEATH ALLOY

This is a continuation-in-part of application Ser. No. 07/822,084 filed Jan. 17, 1992 now U.S. Pat. No. 5,160,382.

BACKGROUND OF THE INVENTION

This invention is directed towards an improved oxidation and corrosion resistant, low cost, iron-base alloy range which forms an eye-appealing, protective dark oxide coating, is highly compatible with high speed autogenous welding practice, and is particularly suitable for use as electric heater element sheathing.

Electric heater elements currently available usually comprise a resistance conductor enclosed in a tubular metal sheath with the resistance conductor embedded in and supported in spaced relation to the sheath by a densely compacted layer of refractory, heat-conducting, electrically insulating material. The resistance conductor may be a helically wound wire member and the refractory material may be granular magnesium oxide.

The material used for the heater sheath must be low-cost, have excellent resistance to oxidation at elevated temperatures, e.g. 850°-900° C., have resistance to stress corrosion cracking, and exhibit good weldability. In addition, it has now become an important requirement that the material used for the heater sheath possess a desirable appearance. Since electric heater elements are usually exposed and are often present in household items such as range tops and dish washers, consumers prefer that the heater element have an eye-pleasing color, such as black or dark gray.

Presently, a large percentage of heater element sheaths are made from INCOLOY® alloy 840 (INCOLOY is a trademark of the Inco family of companies). This alloy, disclosed in U.S. Pat. No. 3,719,308, possesses all the necessary properties for use as heater element sheaths. Additionally, its surface oxidizes to a dark gray color. However, the high cost of this alloy, due in large part to its nominal nickel content of about 20%, has prompted a search for a more economical substitute.

Possible lower-cost alternatives are being contemplated, but they all suffer from drawbacks which make them less than ideal. Type 309 stainless steel and Nippon Yakin's NAS H-22 form undesirable greenish oxides. While Type 321 stainless steel oxidizes to a black color and Type 304 oxidizes to dark gray, they are two-phase alloys, and therefore lack adequate strength, and under certain circumstances, can be difficult to autogenously weld.

It is thus an object of the present invention to provide a material to be used as heater element sheathing which exhibits excellent resistance to oxidation at elevated temperatures, and good weldability characteristics through the formation of a critical amount of δ-ferrite upon solidification, as defined by a ferrite number of 1 to 15.

It is an additional object of the present invention to provide a heater element sheathing material which forms an eye-pleasing dark gray or black surface oxide layer.

It is a still further object of the present invention to provide a heater element sheathing at low cost.

SUMMARY OF THE INVENTION

In accordance with the above objectives, it has now been found that a novel alloy of the following composition is ideal for the required purpose:

| Element | Weight Percent |
|---|---|
| Carbon | 0.05 max. |
| Manganese | 0.30-0.50 |
| Iron | Balance |
| Sulfur | 0.005 max. |
| Silicon | 0.50-2.0 |
| Copper | 0.75 max. |
| Nickel | 8.75-15.5 |
| Chromium | 19.5-21.0 |
| Aluminum | 0.25-0.60 |
| Titanium | 0.25-1.0 |
| Cobalt | 1.0 max. |
| Molybdenum | 1.0 max. |
| Phosphorus | 0.02 max. |
| Calcium + Magnesium | 0.001-0.015 |

All compositions throughout the specification are given in weight percent.

The alloy preferably contains 11.5-15.0% nickel, 0.002% max. sulfur and 0.015% max. phosphorus. An advantageous composition of the alloy comprises about 20.5% chromium by weight and about 14% nickel, as such maximizes the potential for optimum weldability while assuring the formation of a black oxide during sheath manufacture.

The present invention provides a low-cost, oxidation resistant, stress-corrosion cracking-resistant, weldable, strong alloy which oxidizes to a desirable color for use as a heater element sheathing in products such as electric ranges, coiled surface plates and dishwashers, and elsewhere as a low-cost substitute for INCOLOY® alloy 840.

The oxides discussed herein for both the present invention and those of the prior art were all formed by heating at 1078° C. (1970° F.) in an air-methane mixture of ratio 6:1. The method is typical of current industry practice.

BRIEF DESCRIPTION OF THE DRAWING

The FIGURE is a nomogram for determining ferrite number.

DETAILED DESCRIPTION OF THE INVENTION

Various studies were undertaken to demonstrate the efficacy of the claimed alloy composition and the desirablility thereof for use as heater element sheath as compared to known materials.

The chemical composition of the alloys included in the study are provided in Table 1.

TABLE 1.

Two heats of the claimed alloy were made containing 10.75 and 14.88 percent nickel, respectively (Examples A and B). Also, heats of Type 309 stainless steel and alloy NAS H-22 were made. These four alloys were hot and then cold worked down to 0.060 inch thick. In addition, Types 304 and 321 stainless steel, INCOLOY® alloy 800, and three heats of INCOLOY® alloy 840 were included in the testing. The Type 304 stainless steel was cold rolled from 0.125 inch to 0.060 inch. The INCOLOY® alloy 800 was 0.05 inch thick in the hot rolled annealed condition. The three heats of INCOLOY ® alloy 840 were hot worked to 0.30 inch and then cold rolled to 0.018 inch and bright annealed.

One inch square specimens of the alloys were exposed in an electrically heated horizontal tube furnace at 1078° C. (1970° F.) in an air-methane mixture at an air:fuel ratio of 6:1. The time at temperature was five minutes, and the gas flow rate was 500 $cm^3$ per minute. Most of the specimens were first given a 120 grit surface finish. The specimens were then laid flat on a cordierite boat. The mullite furnace tube was sealed at both ends and the boat was pushed into the hot zone with a push rod which passed through a gas tight O-ring seal. After exposure, the specimens were examined. The results are set forth in Table 2.

TABLE 1

| Alloy | C | Cr | Ni | Si | Mn | Mo | Al | Ti | Cu | Ca | Mg |
|---|---|---|---|---|---|---|---|---|---|---|---|
| Example A | 0.035 | 20.71 | 10.75 | 0.57 | 0.30 | 0.28 | 0.39 | 0.41 | 0.28 | .0011 | .0002 |
| Example B | 0.037 | 20.66 | 14.88 | 0.62 | 0.36 | 0.30 | 0.39 | 0.41 | 0.30 | .0018 | .0002 |
| Type 304 SS (nominal) | 0.08 | 18–20 | 8–10.5 | 1.0 | 2.0 | — | — | — | — | — | — |
| Type 309 SS | 0.098 | 23.29 | 14.22 | 0.45 | 0.77 | 0.006 | — | 0.0001 | 0.0001 | .0017 | .0003 |
| Type 321 SS (nominal) | 0.08 | 17–19 | 9–12 | 1.00 | 2.0 | — | — | 0.40 min. | — | — | <.001 |
| INCOLOY ® alloy 840 (specimen 1) | 0.03 | 19.68 | 21.35 | 0.62 | 0.36 | 0.47 | 0.30 | 0.32 | 0.24 | .0008 | .0006 |
| INCOLOY ® alloy 840 (specimen 2) | 0.03 | 19.80 | 18.78 | 0.60 | 0.35 | 0.22 | 0.46 | 0.38 | 0.29 | .0014 | .0005 |
| INCOLOY ® alloy 840 (specimen 3) | 0.03 | 21.32 | 18.63 | 0.57 | 0.36 | 0.44 | 0.42 | 0.37 | 0.17 | .0027 | .0008 |
| Alloy NAS H-22 | 0.022 | 23.62 | 20.74 | 0.69 | 0.36 | 0.021 | 0.13 | 0.21 | 0.019 | .0021 | .0002 |

TABLE 2

Material Description and Resulting Color after Exposure in Air-Methane Mixture (AFR = 6) for 5 Minutes at 1078° C. (1970° F.)

| Alloy | Surface Finish | Color |
|---|---|---|
| Example A | 120 grit | dark gray |
| Example B | 120 grit | dark gray |
| Type 304 SS | 120 grit | dark gray |
| Type 309 SS | 120 grit | green |
| Type 321 SS | 120 grit | black |
| (1) INCOLOY ® alloy 840 | as-rolled + bright anneal | medium gray |
| (1) INCOLOY ® alloy 840 | 120 grit | dark gray |
| (2) INCOLOY ® alloy 840 | as-rolled + bright anneal | dark gray |
| (2) INCOLOY ® alloy 840 | 120 grit | dark gray |
| (3) INCOLOY ® alloy 840 | as-rolled + bright anneal | dark gray |
| Alloy NAS H-22 | 120 grit | greenish dark gray |

The compositional range was arrived at with a view towards the unique characteristics required for heater element sheath. In pursuing this invention, it was necessary to balance the conflicting metallurgical phenomena affecting weldability on the one hand and black oxide formation on the other.

Thus, it was desirable to maintain the highest possible chromium level for ferrite formation without forming green oxide scale. In turn, setting the chromium limit imposes limits on the nickel content. Moreover, the nickel content is in turn limited by cost considerations. A chromium range of 19.5 to 21% (preferably about 20.5%) and a nickel range of 8.75 to 15.5% (preferably about 11.0 to 15.0%) maximizes the potential for optimum weldability while assuring the formation of a dark oxide during sheath manufacture.

To successfully compete as a sheathing alloy, the alloy must be compatible with high speed autogenous welding techniques. This can only be achieved if the alloy composition is carefully balanced such that the percentage of δ-ferrite as defined by its Ferrite Number is between 1 and 15. The Ferrite Number in this invention is defined as in the technical paper, "Ferrite Number Prediction to 100 FN in Stainless Steel Weld Metal," by T. A. Sievart, C. N. McCowen and D. L. Olson in the American Welding Society publication, *Welding Research Supplement*, pp. 289-s to 298-s, December, 1988. These authors define two equations, which the inventors of this invention have modified to be pertinent to the alloys described herein. These equations in combination with the nomogram, shown in the FIGURE, determine the critical relationship between chromium plus molybdenum and nickel plus carbon which will yield the amount of δ-ferrite essential for high speed autogenous welding techniques. The two equations are:

$$Cr_{eq} = \%\ Cr + \%\ Mo \quad (1)$$

$$Ni_{eq} = \%\ Ni + 35x(\%\ C) \quad (2)$$

The nomogram plots $Cr_{eq}$ versus $Ni_{eq}$, with values for the third variable, Ferrite Number, present as diagonal isograms across the grid.

Since the maximum chromium content which will always result in a dark oxide is 20.5%, the maximum permissible $Cr_{eq}$ becomes 21.5 if up to 1.0% molybdenum is present in the alloy. Thus, by locating the isogram for 1, the minimum desired Ferrite Number, it can be seen at point P that the maximum $Ni_{eq}$ becomes about 17.25 at zero percent carbon and the nickel content becomes 15.5% maximum if the carbon is 0.05%. The minimum desirable chromium from a corrosion viewpoint is deemed to be 19.5%; thus, the $Cr_{eq}$ is 19.5 at zero percent molybdenum and 20.5 at 1.0% molybdenum. Consequently, by locating the isogram at Ferrite Number 15, the maximum desirable value, it can be seen at point R that the minimum $Ni_{eq}$ becomes about 10 at zero percent carbon and the nickel level becomes a minimum of 8.75% at 0.05% carbon. The required values for $Cr_{eq}$ and $Ni_{eq}$ must fall within the quadrilateral PQRS of the FIGURE to achieve desired characteristics of color, corrosion-resistance and weldability.

Further, the highest quality welds will occur when the phosphorus content is less than 0.02% (preferably 0.015%), the sulfur content is less than 0.005% (preferably 0.002%) and the residual calcium plus magnesium after deoxidation is from 0.001% to 0.015%.

While the lower limit of 8.75% nickel assures transformation of the δ-ferrite formed during solidification of the weld bead to austenite, it was quite unexpected that the relatively low nickel content would result in a desirable dark gray oxide formation, and would also possess tensile properties similar to INCOLOY alloy 840. Tensile properties for two versions of the claimed alloy and INCOLOY alloy 840 are compared below in Table 3.

TABLE 3

TENSILE DATA FOR EXPERIMENTAL ALLOYS vs. INCOLOY ® ALLOY 840

| | Yield Strength (ksi) | Ultimate Tensile Strength (ksi) | Elongation (%) |
|---|---|---|---|
| ROOM TEMPERATURE TENSILE DATA | | | |
| Example A | 36.5 | 88.6 | 41.0 |
| Example B | 26.1 | 76.1 | 46.0 |
| INCOLOY ® alloy 840 | 30.8 | 82.8 | 40.0 |
| 800° C./1472° F. TENSILE DATA | | | |
| Example A | 15.5 | 23.6 | 66.5 |
| Example B | 13.9 | 29.8 | 66.0 |
| INCOLOY ® alloy 840 | 15.0 | 26.6 | 81.5 |

Aluminum and titanium are integral components of the alloy. Aluminum, at 0.25–0.60%, contributes to oxidation- and corrosion-resistance; and titanium, at 0.25–1.0%, in conjunction with the carbon as titanium carbide, contributes to grain size stability.

The particular oxidizing atmosphere utilized, i.e., air-methane 6:1, was chosen because it is simple, inexpensive and in general use throughout the industry. It is contemplated that other known oxidizing atmospheres or methods may be used to achieve similar results.

Although the present invention has been described in conjunction with the preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A weldable, oxidation- and corrosion-resistant alloy which obtains, upon oxidation, a protective oxide layer ranging in color from dark gray to black, the alloy consisting essentially of, by weight, from about 8.75–15.5% nickel, about 19.5–21.0% chromium, about 0.30–0.50 manganese, about 0.50–2.0% silicon, about 0.25–0.60% aluminum, about 0.25–1.0% titanium, up to about 0.05% carbon, up to about 0.005% sulfur, up to about 0.75% copper, up to about 1.0% cobalt, up to about 1.0% molybdenum, up to about 0.02% phosphorus, about 0.001–0.015% calcium plus magnesium and remainder essentially iron, wherein the Ferrite Number is between 1 and 15.

2. The alloy of claim 1, wherein nickel is present at about 11.5–15%.

3. The alloy of claim 2, wherein sulfur does not exceed about 0.002% and phosphorus does not exceed about 0.015%.

4. The alloy of claim 3, wherein nickel is present at about 14% and chromium is present at about 20.5%.

5. A weldable, oxidation- and corrosion-resistant alloy which obtains, upon oxidation, a protective oxide layer ranging in color from dark gray to black, the alloy consisting essentially of, by weight, from about 8.75–15.5% nickel, about 19.5–21.0% chromium, about 0.30–0.50 manganese, about 0.50–2.0% silicon, about 0.25–0.60% aluminum, about 0.25–1.0% titanium, up to about 0.05% carbon, up to about 0.005% sulfur, up to about 0.75% copper, up to about 1.0% cobalt, up to about 1.0% molybdenum, up to about 0.02% phosphorus, about 0.001–0.015% calcium plus magnesium and remainder essentially iron, wherein the amounts of chromium, molybdenum, nickel and carbon are determined according to the formulae:

$$Cr_{eq} = \%\ Cr + \%\ Mo \quad (1)$$

$$Ni_{eq} = \%\ Ni + 35(\%\ C) \quad (2)$$

and the permissible values of $Cr_{eq}$ and $Ni_{eq}$ lie within the quadrilateral PQRS of the FIGURE.

6. The alloy of claim 5, wherein nickel is present from about 11.5–15%.

7. The alloy of claim 6, wherein sulfur does not exceed about 0.002% and phosphorus does not exceed about 0.015%.

8. The alloy of claim 7, wherein nickel is present at about 14% and chromium is present at about 20.5%.

9. A heater element comprising a sheathing having a protective oxide layer ranging in color from dark gray to black, said sheathing being formed from an alloy consisting essentially of, by weight, from about 8.75–15.5% nickel, about 19.5–21.0% chromium, about 0.30–0.50% manganese, about 0.50–2.0% silicon, about 0.25–0.60% aluminum, about 0.25–1.0% titanium, up to about 0.05% carbon, up to about 0.005% sulfur, up to about 0.75% copper, up to about 1.0% cobalt, up to about 1.0% molybdenum, up to about 0.02% phosphorus, about 0.001–0.015% calcium plus magnesium, and remainder essentially iron, wherein the alloy has a Ferrite Number of between 1 and 15.

10. The heater element of claim 9, wherein nickel is present from about 11.5–15%.

11. The heater element of claim 10, wherein the sulfur does not exceed about 0.002% and phosphorus does not exceed about 0.015%.

12. The heater element of claim 11, wherein nickel is present at about 14% and chromium is present at about 20.5%.

* * * * *